United States Patent [19]

Gueret

[11] Patent Number: 4,930,919

[45] Date of Patent: Jun. 5, 1990

[54] APPLICATOR UNIT INCLUDING DEVICE FOR COMPACTING THE PRODUCT ON THE APPLICATOR

[75] Inventor: Jean-Louis Gueret, Paris, France

[73] Assignee: L'Oreal, Paris, France

[21] Appl. No.: 238,426

[22] Filed: Aug. 31, 1988

[30] Foreign Application Priority Data

Aug. 31, 1987 [FR] France ..... 87 12073

[51] Int. Cl.[5] ..... A45D 40/00; A45D 40/10

[52] U.S. Cl. ..... 401/126; 401/129

[58] Field of Search ..... 401/176, 180, 171, 126, 401/125, 124, 123, 118, 129, 4

[56] References Cited

U.S. PATENT DOCUMENTS

| | | | |
|---|---|---|---|
| 2,193,509 | 3/1940 | Deakers . | |
| 2,631,826 | 3/1953 | Wolf | 401/4 |
| 2,990,834 | 7/1961 | Amen | 401/4 |
| 3,694,096 | 9/1972 | Seidler | 401/127 |
| 3,951,157 | 4/1976 | Idec | 401/130 X |
| 3,957,066 | 5/1976 | Pahm | 401/122 |
| 4,527,575 | 7/1985 | Uasas | 401/129 M |
| 4,780,017 | 10/1988 | Bradford | 401/186 |

FOREIGN PATENT DOCUMENTS

| | | | |
|---|---|---|---|
| 817101 | 7/1949 | Fed. Rep. of Germany | 401/118 |
| 57306 | 1/1953 | France | 401/180 |
| 2071574 | 9/1971 | France . | |
| 595957 | 7/1959 | Italy | 401/180 |
| 358714 | 1/1962 | Switzerland | 401/4 |
| 18768 | 12/1988 | United Kingdom | 401/125 |

*Primary Examiner*—Steven A. Bratlie

*Attorney, Agent, or Firm*—Cushman, Darby & Cushman

[57] ABSTRACT

The applicator unit (1) comprises a bottle (2) provided with a neck (3) intended to contain the product (P), a cap (4) for closing the bottle and an applicator (6) disposed at the end of a stem (7) integral with the cap (4). The bottle (2) comprises at its end (23) on the opposite side to that provided with the neck (3), means (C) for compacting the product around the applicator (6) on which means the user can act and elastic means (R) for restoring these compacting means (C) into their rest position when the user's action ceases.

10 Claims, 1 Drawing Sheet

APPLICATOR UNIT INCLUDING DEVICE FOR COMPACTING THE PRODUCT ON THE APPLICATOR

Figure 1:
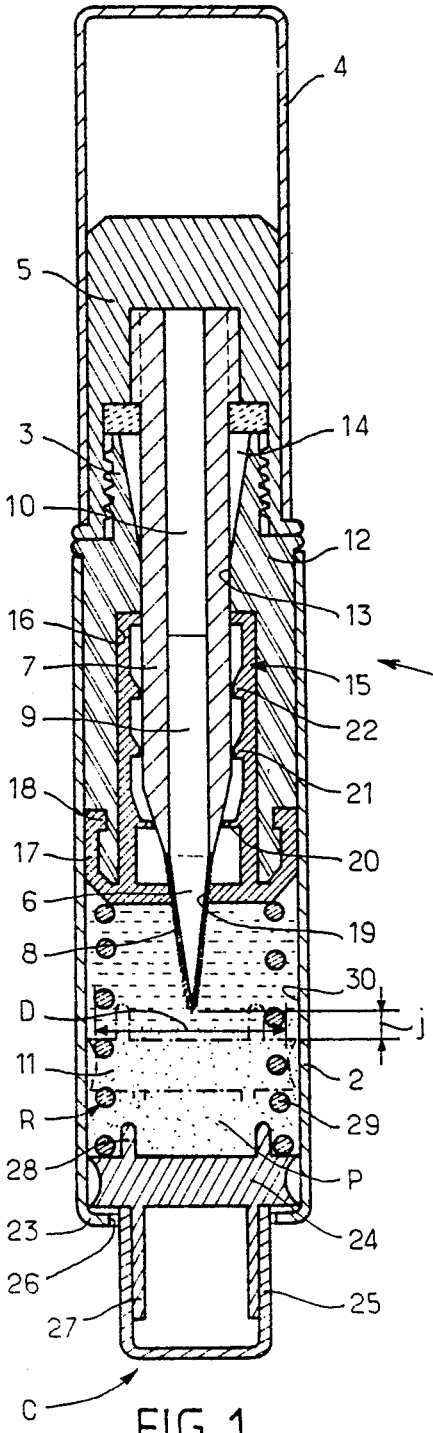

The invention relates to an applicator unit for a powder or paste product, a cosmetic product in particular, of the kind comprising a bottle, provided with a neck, intended to contain the powder product, a cap to close the bottle and an applicator disposed at the end of a stem integral with the cap.

The invention concerns more particularly, but not exclusively, an applicator unit for mascara of the type for tracing lines on the eyelids.

When the bottle of such a unit contains a powder, for example, a make up powder, without a fatty binding agent, a good distribution of the powder is obtained on the applicator mounted at the end of the stem, this applicator allowing a relatively satisfactory positioning. However, such a powder is volatile because it is too dry and does not cling well to the application surface, for example, an eyelid.

It is therefore preferable to use a powder comprising a fatty binding agent which stays in place.

However, such a powder which, whilst being slightly fatty, remains free, is more difficult to distribute with an applicator unit of the kind defined above wherein in general, the applicator is disposed at the end of the stem and has a tapering shape, for example, a frustoconical one. Such a powder comprising some binding agent, hereinafter referred to a free fatty powder, has a tendency to form lumps which make it difficult, if not impossible to impregnate the applicator. Moreover, the free fatty powder does not adhere well to the said applicator.

The object of the invention is, above all, to provide an applicator unit for a powder product of the kind defined above, meeting the various practical requirements better than heretofore, and which would make it possible in particular to apply a powder comprising a fatty binding agent under favourable conditions. More particularly when such a unit is equipped with an applicator, the aim of the invention is to make it possible to effect the making up equally well both along lines or in strokes, and on a surface, for example, the surface of the eyelid.

It is, moreover, desirable for an applicator unit with which the results set out above can be obtained, to be of a simple and economic design, and be easy to manipulate.

According to the invention, a unit for applying a powder or paste product, in particular a cosmetic product of the kind defined above, is characterised in that the bottle comprises at its end on the opposite side to that provided with the cap and with the applicator, means for compacting the product around the applicator which the user can activate, and elastic means for restoring the compacting means into their rest position when the user's action ceases.

Preferably, the compacting means comprise a piston slidably mounted in the bottle, this piston being connected to a push button projecting beyond the end of the bottle on the opposite side to the cap.

The piston can be provided with a central hole allowing the applicator to be filled with the product and provision is made for means for closing the central hole after the applicator has been filled. The piston provided with the hole can be mounted at the end of a cylindrical sleeve and the means for closing the hole comprise a cylindrical extension of the push button engaged in the sleeve.

Advantageously, the elastic restoring means comprise a helical spring disposed between the piston and an element, a wiper carrier in particular, surrounding the applicator.

The diameter of the turns of the spring is advantageously chosen in such a way that the external surface of these turns could scrape the internal surface of the bottle, so as to restore the powder to its suspended state when the push button is released.

The helical spring is chosen in such a way that when its turns are contiguous, the piston is kept at a distance from the near end of the applicator, so that at the end of its travel, the piston cannot interfere with the said applicator.

The end of the chamber situated in the bottle on the side of the applicator, can have a frustoconical shape converging towards the applicator to promote the compacting of the product around this applicator.

The said applicator, as described above, can have a tapered shape and be constituted by a frustoconical end fitting or "pen"; this end fitting can be covered with fibres, by flocking in particular, and can be made of foam, possibly reinforced, of felt or an elastomeric substance.

The helical spring is advantageously mounted on the piston with a tight grip, so as to be joined for rotation with this piston which is mounted for rotation in the bottle in such a way that it is possible to impart a rotational movement to the piston and to the spring, combined with the translational movement to remove the powder and to suppress the accretions which may possibly be formed.

The powder can comprise micro-capsules comprising products such as oils, binding agents or active substances, these micro-capsules being capable of releasing their product near the applicator during the compacting stage.

Apart from the arrangements set out above, the invention consists of a certain number of other arrangements which will be discussed in greater detail below with reference to the attached drawings but which are in no way restrictive.

FIG. 1 of these drawings is a longitudinal cross section of an applicator unit in accordance with the invention.

Figure 2:
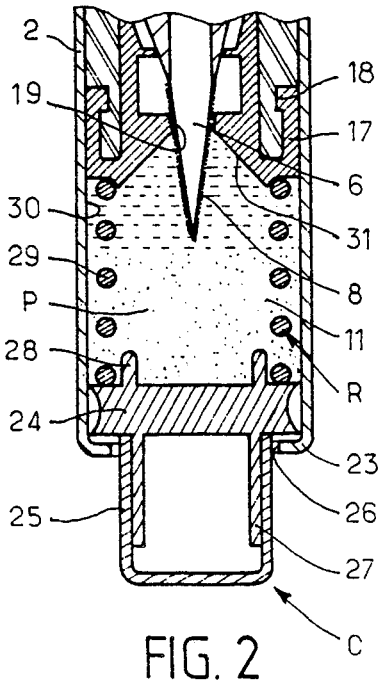

FIG. 2 is a partial cross section of a variant of the embodiment of the unit of FIG. 1.

Figure 3:
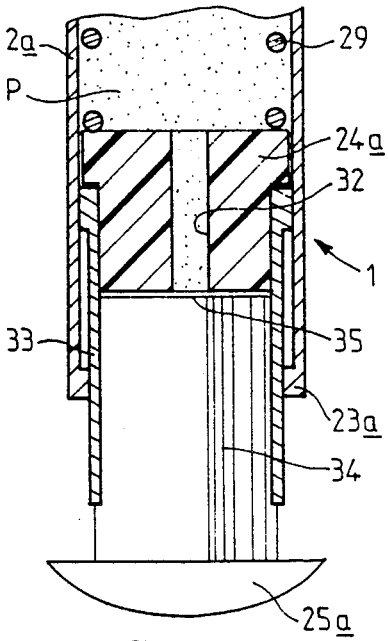

Finally, FIG. 3 is a partial cross section of a variant of the embodiment of the piston.

Referring to FIG. 1 of the drawings, one may see an applicator unit 1 of a product P in powder form, in particular a cosmetic product such as mascara mixed with a fatty binding agent and constituting a free fatty powder. The applicator unit 1 comprises a bottle 2 intended to contain the product P. This bottle 2 generally has a cylindrical form of revolution; it is provided with a neck 3 whose external diameter is smaller than that of the bottle.

A cap 4 is provided to close the bottle. Provision is made for complementary means between the cap 4 and the neck 3 to ensure the connection and fastening of the cap on the bottle. These means are preferably formed by an external thread provided on the external well of the neck 3, capable of cooperating with an internal thread provided in end fitting 5 integral with the cap.

An applicator 6 is disposed at the end of a stem 7 integral with the cap 4 and, more particularly, integral with the end fitting 5. The applicator 6 preferably has a tapered frustoconical shape and is advantageously made of a flexible material at least partly covered by a fibrous coating 8, by flocking in particular.

The point forming the applicator 6 is extended on the side of the cap by a cylindrical portion 9 engaged with a tight fit in a bore 10 of the hollow stem 7, so as to ensure the connection between the applicator 6 and this stem.

The bottle 2 comprises a substantially cylindrical reservoir 11 whose end turned towards the cap 4 is provided with an element 12 forming a wiper carrier rendered integral with the reservoir 11. The neck 3 is carried by this element 12 advantageously made of a plastic material.

The wiper carrier element 12 comprises a central cut out 13 substantially coaxial with the reservoir 11 which issues on the side of the cap 4, via a flared frustoconical opening 14 which facilitates the insertion of the applicator 6 into the bottle.

A device 15 for wiping the applicator 6 when it is withdrawn from the bottle is mounted in a cylindrical housing 16 of the element 12. This housing 16, coaxial with the cut out 13, has a larger diameter than this cut out and issues on the side of the element 12 on the opposite side to the neck 3. The device 15 is formed by a sleeve made of a flexible material, in particular an elastomeric material engaged in the housing 16, this sleeve comprising at its end remote from the neck 3, a peripheral skirt 17 forming a return along the axial direction, capable of covering the end of the device 15 and of catch engagement by means of a bead 18 in a corresponding groove, provided at the end of the element 12 with a smaller diameter. The external surface of the skirt 17 is tightly gripped against the internal surface of the reservoir 11. The transverse end of the device 15 remote from the neck 3 delimits a passage opening 19 intended to be traversed by the applicator 6 which, after the cap 4 has been screwed on to the neck 3, comes to bear in a relatively leak proof manner against the wall of the said opening 19.

Inside the sleeve 15, provision is made for several wiper lips, that is to say, in the example considered, three lips 20, 21, 22 which are substantially regularly distributed along the axial direction, between the opening 19 and the end on the opposite side to the sleeve 15. The diameter of the passage opening delimited by the lip 20 is smaller than that of the holes delimited by the lips 21 and 22; when the cap 4 is screwed on to the neck 3, the lip 20 is intended to bear against the frustoconical end wall of the hollow stem 7, whilst the lips 21, 22 surround the cylindrical portion of this stem.

It should be noted that the passage opening 19 is preferably star shaped with radial slots angularly interspaced in a regular manner.

According to the types of use, the point 6 will be coated over the whole of its surface, or only over a part thereof, by the fibrous coating 8. In particular, it may be advantageous to coat only the pointed end of the tip 6 over an axial length of approximately 3 mm.

The fibrous coating 8 can be deposited by a flocking process which lies in coating the lower portion of the applicator 6 with a monomeric liquid adhesive, either by simple immersion, or by spraying the said adhesive by means of a gun, and subsequently causing the element 6 thus impregnated, to pass into a powder of particles of rayon, nylon or of cotton, whose length is comprised between 0.2 to 1.5 mm, according to the degree of charging desired. These particles are held in a suspension in air and are deposited on the impregnated surface of the applicator 6 by electrostatic attraction; because of this, in most cases, the particles are orientated substantially perpendicular to the impregnated surface.

The applicator 6 thus coated is then caused to pass into an oven, so as to polymerise the monomeric adhesive. After cooling, the superfluous particles are removed by suction.

In accordance with the invention, the bottle 2 comprises at its end 23 on the opposite side to that provided with the neck, means C for compacting the powder around the applicator 6, which means can be activated by a user, as well as elastic means R for restoring these compacting means C into their rest position when the user stops acting on the means C. Preferably, the compacting means C comprise a piston 24 slidably mounted in the bottle 2, and more precisely in the reservoir 11, this piston being connected to a push button 25 projecting through the end 23 of the bottle by passing through a circular opening 26 arranged in this end. The piston 24 is retained inside the bottle by a flange formed by the end 23.

The piston 24 is advantageously provided on the opposite side to the neck 3 with a cylindrical sleeve 27 which is coaxial with the piston. The button 25 formed by a hollow cylinder closed by a transverse bottom, has a smaller diameter, so that the sleeve 27 can be engaged with a tight grip inside this button 25. The piston 24 is thus joined for translation and rotation to the button 25.

On the opposite side to the sleeve 27, the piston 24 comprises a coaxial cylindrical skirt 28 projecting towards the inside of the bottle 2.

The elastic restoring means comprise preferably a helical spring 29 disposed between the piston 24 and the wiper carrier element 12. The external diameter D of the turns of the spring 29 is such that the external surface of these turns can scrape the internal surface 30 of the reservoir 11 of the bottle 2 in order to put the powder P into a state of suspension again when the push button 25 is released.

The spring 29 is, moreover, chosen in such a way that when its turns are contiguous, the piston 24 is held in the position represented in dashes in FIG. 1, separated by a distance j from the near end of the applicator 6, so that at the end of its travel the piston 24 should not come to interfere with the said applicator 6.

The external diameter of the skirt 28 is such that the end of the spring 29 near the piston 24, is tightly engaged on the skirt 28, so that the spring 29 should be joined for rotation to the piston 24 which can slide and turn in the reservoir 11.

The functioning of such an applicator unit is as follows.

With a view to applying some powder P to a surface, the user depresses the push button 25 so as to displace the piston 24 towards the applicator 6. When the turns of the spring 29 are contiguous, the piston 24 is in its end of travel position. As explained above, the travel of the piston is voluntarily limited so as not to damage the applicator 6.

The displacement of the piston 24 produces compacting of the powder P around the applicator 6, which compacting has the effect of charging this applicator with powder.

The user then releases the button 25 and the turns of the spring 29 move away from each other, scraping the internal surface of the reservoir 11 and returning the powder P into a state of suspension.

The applicator 6 is then ready for use. The user can unscrew the cap 4 and extract the applicator 6 suitably charged with powder with a view to its application.

As the piston 24 is being returned to its rest position, bearing against the end 23, the effect of the turns of the spring 29 makes it possible to lose as little powder as possible.

Moreover, the push button 25 can be made to turn and to cause the spring 29 to rotate therewith which has the effect of breaking up any possibly compacted duct around the applicator 6, so as to replace the powder into a state of suspension.

The formation of accretions is prevented by the action of the spring.

It is not necessary to activate push button 25 before each use.

It should be noted that the powder P can comprise microcapsules containing products such as oils, binding agents, active substances, such as hydrating agents, or substances with a hypoallergenic treatment effect, anti-wrinkle substances, or active agents in the field of dermatology. During the compacting of the powder near the applicator 6, the micro-capsules release their product.

It should, moreover, be noted that the projection of the applicator 6 through the opening 19 in the reservoir 11 can be reduced, the end of the point 6 being relatively remote from the median plane of the end 23 of the bottle.

Reference will now be made to the variant of the embodiment of FIG. 2. The elements of this Figure which are identical or perform similar functions to the elements already described with reference to FIG. 1, are designated by the same references without a repetition of their description.

The end of the chamber containing the powder P situated on the side of the applicator 6 has a frustoconical shape 31 converging towards the applicator to promote the compacting of the powder P around this applicator when the push button 25 is depressed. This shape 31 is obtained at the level of the end of the element 12 provided with the wiper 15 which closes the chamber wherein the powder P is located.

Referring to FIG. 3, a variant of the embodiment may be seen according to which the piston **24*a* is provided with a central hole 32 which allows the applicator to be filled with the powder P. The piston 24*a* is mounted with a tight grip at one end of a cylindrical sleeve 33 which is capable of sliding in the bottle 2*a*. This sleeve 33 projects out of the bottle at its other end. After the bottle has been filled with the product, the push button 25*a* is positioned in the external end of the sleeve 33. This push button 25*a* comprises a cylindrical extension 34 engaged with a tight grip in the sleeve 33 and whose internal end 35 comes to be near the hole 32** to close it.

Irrespective of the embodiment adopted, the device of the invention makes it possible to obtain make up effects resembling those which are obtained by means of an applicator pad of a compact with compressed powder. The device of the invention is of small size, substantially corresponding to that of a fountain pen and has the advantage of being easier to carry and to use than a conventional eye shadow compact.

Such a device could also serve for the application of a cream which would be contained in the bottle. The device of the invention would make it possible to saturate an applicator mounted on a relatively short stem and therefore easier to use than the applicators which penetrate as far as the bottom of the containers. Simple pressure on the piston would allow product doses already used to be recovered every time.

Generally speaking, according to the invention, the applicator can be recharged without being completely inserted into the bottle.

I claim:

1. An applicator unit for applying a powder or paste product comprising:

a bottle for containing the product, said bottle having proximal and distal ends, said proximal end having an opening defined therethrough and a neck defined about said opening;

a cap element for engaging said neck to close said opening;

a stem having a proximal end and a distal end, said proximal end of said stem being coupled to said cap so that said stem is disposed within said bottle when said cap closes said opening;

an applicator defined on the distal end of said stem;

means defined at said distal end of said bottle for compacting the product around the applicator, said compacting means having a rest position and an actuated position wherein the product is compacted around the applicator, said compacting means being actuatable by a user of the unit to move said compacting means from said rest position to said actuated position; and elastic means for restoring the compacting means to said rest position following actuation by the user;

said compacting means comprising a piston slidably mounted in the distal end of the bottle, said piston being joined to a push button projecting beyond the distal end of the bottle.

2. An applicator unit according to claim 1, wherein the piston is provided with a central hole allowing the applicator to be filled with the product and further comprising means for closing the central hole after the applicator has been filled.

3. An applicator unit according to claim 2, wherein the piston is mounted at one end of a cylindrical sleeve (33) and the means for closing the central hole comprise a cylindrical extension of the push button engaged in the sleeve.

4. An applicator unit according to any one of the claims 1, 2 or 3, wherein the elastic restoring means comprise a helical spring disposed between the piston and a wiper carrier surrounding the applicator.

5. An applicator unit according to claim 4, wherein the external diameter of the turns of the spring is such that the external surface of the turns can scrape the internal surface of the bottle so as to return the product to its state of suspension when the push button is released.

6. An applicator unit according to claim 5, wherein the helical spring is configured so that when its turns are contiguous, the piston is spaced from the distal end of the applicator, so that at the end of its travel, the piston is spaced from said applicator.

7. An applicator unit according to claim 4, wherein the applicator has a pointed conical shape, provided with a fibrous coating by flocking.

8. An applicator unit according to claim 4, wherein the spring is mounted for rotation relative to the piston and the push button in such a way that it is possible to impart a rotational movement to this spring from the push button to agitate the product.

9. An applicator unit according to claim 12, wherein the distal end of the chamber has a frustoconical shape converging towards the applicator to promote the compacting of the product around the applicator.

10. An applicator unit according to claim 1, wherein the powder comprises micro-capsules containing at least one of oils, binding agents and active substances, the micro-capsules releasing their product in the vicinity of the applicator during compacting.

* * * * *